US012514380B2

(12) United States Patent
Zheng

(10) Patent No.: US 12,514,380 B2
(45) Date of Patent: Jan. 6, 2026

(54) SMART MATTRESS CAPABLE OF HEIGHT ADJUSTING IN BALANCED MANNER

(71) Applicant: Guangdong Guozhan Technology Co., Ltd., Dongguan (CN)

(72) Inventor: Shengju Zheng, Dongguan (CN)

(73) Assignee: Guangdong Guozhan Technology Co., Ltd., Dongguan (CN)

( * ) Notice: Subject to any disclaimer, the term of this patent is extended or adjusted under 35 U.S.C. 154(b) by 111 days.

(21) Appl. No.: 18/544,372

(22) Filed: Dec. 18, 2023

(65) Prior Publication Data

US 2024/0260765 A1 Aug. 8, 2024

(30) Foreign Application Priority Data

Feb. 7, 2023 (CN) ..... 202310097149.5

(51) Int. Cl.
*A47C 31/12* (2006.01)
*A47C 23/043* (2006.01)

(52) U.S. Cl.
CPC ..... *A47C 31/123* (2013.01); *A47C 23/043* (2013.01)

(58) Field of Classification Search
CPC ... A47C 31/123; A47C 23/002; A47C 23/043; A47C 23/0431
See application file for complete search history.

(56) References Cited

U.S. PATENT DOCUMENTS 10,588,420 B1 * 3/2020 Krenik ..... A47C 19/027
11,653,769 B2 * 5/2023 Duncan ..... A47C 27/065 5/720
2004/0231057 A1 * 11/2004 Sabin ..... A47C 23/002 5/717
2012/0200018 A1 * 8/2012 Paz ..... A47C 7/027 267/166.1
2013/0145557 A1 * 6/2013 Hsu ..... A47C 31/123 5/697
2014/0137337 A1 * 5/2014 DeFranks ..... A47C 27/06 5/722
2015/0351982 A1 * 12/2015 Krenik ..... A47C 23/06 5/616

(Continued)

FOREIGN PATENT DOCUMENTS

CN 105768686 A * 7/2016 ..... A47C 27/063
CN 105768686 B * 1/2018 ..... A47C 27/06

(Continued)

*Primary Examiner* — David E Sosnowski

(57) ABSTRACT

The invention discloses a smart mattress capable of height adjusting, comprising: a foundation; a sleeping pad; a plurality of height adjusting mechanisms arranged between the foundation and the sleeping pad, the height adjusting mechanism includes a positioning plate fixed on the foundation, a gravity sensor located below the positioning plate, an elevating drive device, a covering, a tray and an elastic member; the tray is located below the covering, the elastic member is installed on the periphery of the covering; wherein, one end of the elastic member is fixedly installed on the tray, the other end is fixedly connected with a planar deformable member, the sleeping pad is defined on the planar deformable member, the elevating drive device is used to drive the covering to lift or to drive the elastic member to deform. The present invention provides users with the best sleeping comfort.

7 Claims, 6 Drawing Sheets

(56) References Cited

U.S. PATENT DOCUMENTS

| | | | | |
|---|---|---|---|---|
| 2020/0187665 | A1* | 6/2020 | Duncan | A47C 27/045 |
| 2020/0405072 | A1* | 12/2020 | Yu | G16H 20/30 |
| 2021/0137277 | A1* | 5/2021 | Kirchhoff | A47C 27/083 |
| 2025/0176733 | A1* | 6/2025 | Leng | A47C 27/07 |
| 2025/0261766 | A1* | 8/2025 | Leng | A47C 27/063 |

FOREIGN PATENT DOCUMENTS

| | | | | | |
|---|---|---|---|---|---|
| CN | 105380762 | B | * | 12/2018 | A61G 7/057 |
| CN | 109588906 | A | * | 4/2019 | A47C 27/061 |
| CN | 110292277 | A | * | 10/2019 | A61B 5/6892 |
| CN | 211483736 | U | * | 9/2020 | |
| CN | 109588906 | B | * | 1/2021 | A47C 27/061 |
| CN | 113693399 | A | * | 11/2021 | A47C 23/047 |
| CN | 110292277 | B | * | 9/2024 | G05D 27/02 |
| GB | 2627059 | A | * | 8/2024 | A47C 31/123 |
| KR | 101119550 | B1 | * | 2/2012 | A47C 27/07 |
| WO | WO-2014081770 | A1 | * | 5/2014 | A47C 27/14 |
| WO | WO-2016033842 | A1 | * | 3/2016 | A61G 7/057 |

* cited by examiner

SMART MATTRESS CAPABLE OF HEIGHT ADJUSTING IN BALANCED MANNER

CROSS-REFERENCE TO RELATED APPLICATIONS

This application claims the benefit of Chinese Application 202310097149.5 for a smart mattress capable of height adjusting in balanced manner (filed Feb. 7, 2023 at the China National Intellectual Property Administration, CNIPA). The entire contents of above applications are hereby incorporated by reference in their entirety.

TECHNICAL FIELD

The invention pertains to the field of mattress, particularly to a smart mattress capable of height adjusting and being stressed in balanced manner.

BACKGROUND

Mattress is a generally know item used between the human body and the bed to ensure the user's health and sleeping comfort. The conventional mattresses are all integrated, with similar structures, mainly manifested in different materials, such as latex mattresses, palm mattresses, spring mattresses, and so on. None of the of these known mattresses are capable of height adjusting, and the degree of deformation that the mattress bears varies due to different weight of different portions when the human body is lying on the mattress. For example, the deformation near the head is greater than that of the feet, and the overall load-bearing capacity of the mattress is unbalanced, making it difficult for the human body to achieve optimal comfort. Thus, there is a need for improvement in this field.

SUMMARY

There is a need for improvement in the field. The present invention provides a smart mattress that can balance the body's stress, and automatically adjust the height of specific areas of the mattress to balance the load-bearing weight at various sleeping positions, thereby providing users with best sleeping comfort.

In accordance with an aspect of the embodiment, there is provided a smart mattress capable of height adjusting in balanced manner, comprising: a foundation; a sleeping pad; a plurality of height adjusting mechanisms arranged between the foundation and the sleeping pad, the height adjusting mechanism includes a positioning plate, a pressure sensor, an elevating drive device, a covering, a tray and an elastic member; the positioning plate is fixed on the foundation, the pressure sensor is located below the positioning plate, the tray is located below the covering, the elastic member is installed on the periphery of the covering; wherein, one end of the elastic member is fixedly installed on the tray, the other end is fixedly connected with a planar deformable member, the sleeping pad is defined on the planar deformable member, the elevating drive device is used to drive the covering to lift or to drive the elastic member to deform.

Preferably, the elevating drive device is provided with a hoisting motor and a pushing rod connected to the hoisting motor, the pushing rod is fixedly connected to the covering and drives the covering to move up and down.

Preferably, the elevating drive device includes a driving motor and a winding assembly, the winding assembly includes a winding reel connected to the driving motor and a wire coiled on the winding reel, a free end of the wire is connected to the elastic member, as the driving motor drives the winding reel to rotate, the wire is retracted and released, thereby pulling the elastic member to extend or retract.

Preferably, the covering is inverted U-shaped and forms an accommodating cavity, the tray is provided with an avoidance hole for the elevating drive device to pass through, the elevating drive device is vertically installed on the positioning plate and extends into the accommodating cavity.

Preferably, further includes a cushion block, the cushion block is fixedly installed at the bottom of the positioning plate, and the pressure sensor is fixedly installed at the bottom of the cushion block, the positioning plate is fixedly installed on the foundation via the pressure sensor.

Preferably, the planar deformable member comprises a plurality of independent cushion pads arranged in an array, the size of each cushion pad is equal or some cushion pads have the same size, each height adjusting mechanism is independently provided, the elastic member of each height adjusting mechanism is connected with the corresponding cushion pad and adjust the height of the corresponding cushion pad.

Preferably, the foundation includes a plurality of beams and a plurality of enclosure frames, two adjacent beams are fixedly assembled by a metal sheet, each enclosure frame is fixed around the assembled beams to form the foundation.

Preferably, the sleeping pad is configured as a latex sleeping pad.

Preferably, the smart mattress further includes a data control system, a driver, and a terminal system, the driver and the data control system are installed on the foundation, the driver, the terminal system, and the pressure sensor are electrically connected to the data control system.

Compared with the prior art, the present invention has the following advantages and beneficial effects.

1. The mattress of the present invention automatically monitor the parameters of the human body lying on the sleeping pad via the pressure sensor. Based on the parameters monitored by the pressure sensor, the pluralities of the independent elevating drive devices drive the covering to lift and deform the elastic member, in order to adjust the height of specific areas of the sleeping pad and balance the weight of each sleeping position, thereby providing users with the best sleeping comfort. Of course, the elevating drive device can also directly pull the elastic member to extend or retract, in order to adjust the height of the specific area of the planar deformable member, then adjust the height of the specific area of the sleeping pad. The specific use is also applicable for back sleeping, side sleeping or turning over during sleeping, the pressure sensor automatically monitors the data and corrects the height of the mattress, thereby achieving an automatic balance adjustment on the mattress as a whole.
2. The disclosure is provided with the data control system, the driver and the terminal system (such as an independent remote control or a mobile phone APP). The data control system receives parameters from each pressure sensor, analyzes and compares the data, and controls the parameters of the elevating drive device via the driver to accurately adjust the height of the sleeping pad. Certainly, the data control system is also able to adjust the positions of specific areas of the sleeping pad to a balanced state based on parameters such as human height, weight, and body shape, combined with real-time detection data from the pressure sensor 31. Meanwhile, the terminal system is an independent remote control, alternatively a mobile phone specific app, where users is able to adjust the height of the sleeping pad to the most comfortable state based on their own needs, so as to meet their customized needs.

3. The plane deformable member is configured as a modular combination. The combination of the planar deformable member is diverse, which can be formed by an array of multiple equally sized cushion blocks, or by combining multiple smaller cushion blocks and larger cushion blocks. The quantities of the height adjustment mechanism is also changeable, for example, only some of the cushion blocks is provided with the elastic members while some cushion blocks are not provided with the elastic members, it means that elastic member is not essential to cover the entire mattress. For example, when providing a user-customized mattress, it is configured according to personized needs, such as the position of the waist, head, feet, etc., which is adjusted based on its weight to achieve the best comfort even when there are differences in human body shape. Thus the cost of the mattress is significantly reduced. Moreover, the mattress is designed with a modular design, which can be disassembled during transportation and assembled on-site, making the transportation of the mattress more convenient.
4. The foundation is detachable for easy transportation, and the users could install it on site or at home easily. The beams are fixed together in pairs with the metal sheet, then the enclosure frame is assembled around the assembled beams to form the entire foundation. Finally, the independent height adjustment mechanisms are assembled one by one at the designated positions of the foundation, and then connected to the sleeping pad.

BRIEF DESCRIPTION OF DRAWINGS

The drawings refer to embodiments of the present disclosure in which.

DETAILED DESCRIPTION OF THE EMBODIMENTS

The invention will be further described below in details with reference to the figures and embodiments. Relative items such as up and down are for convenience only and are not intended to be limiting.

Figure 1:
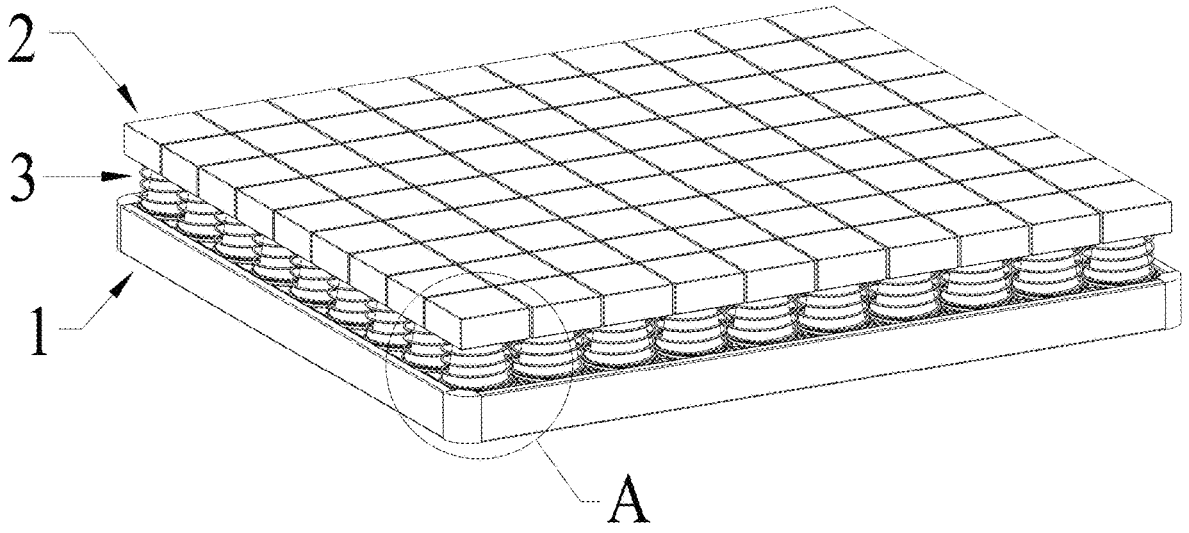
FIG. 1 shows a schematic view of the present disclosure.
Figure 2:
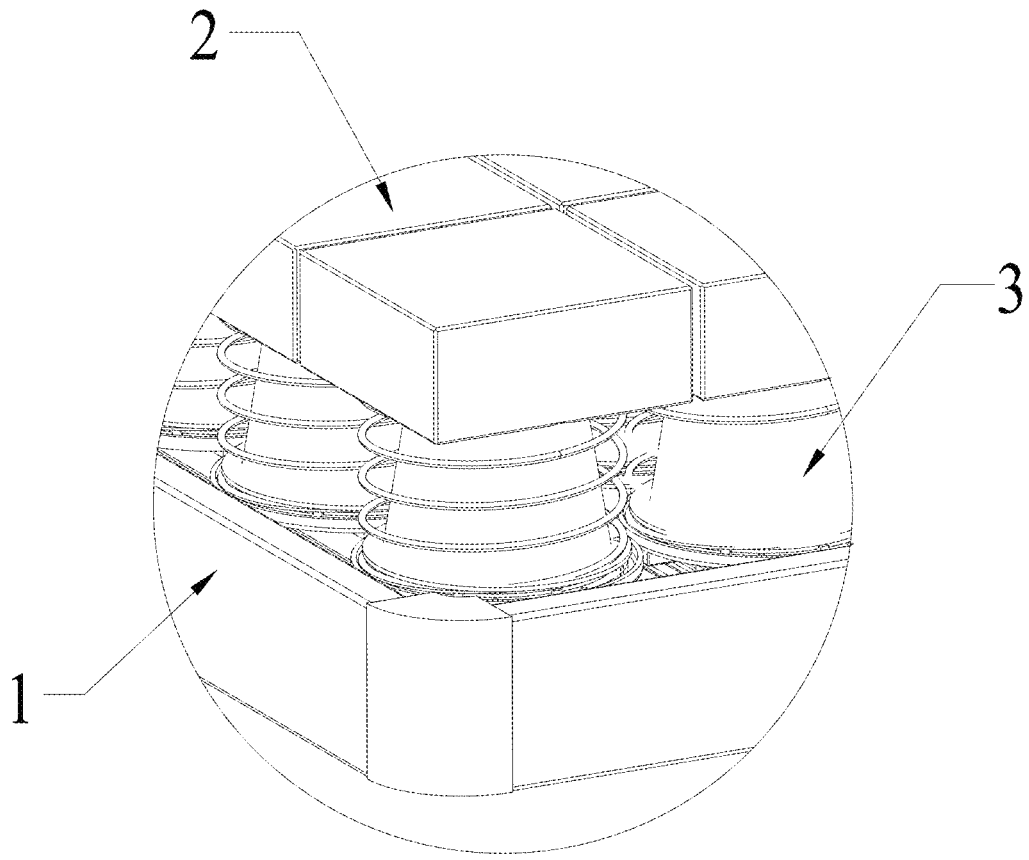
FIG. 2 shows an enlarged view of A in FIG. 1.
Figure 3:
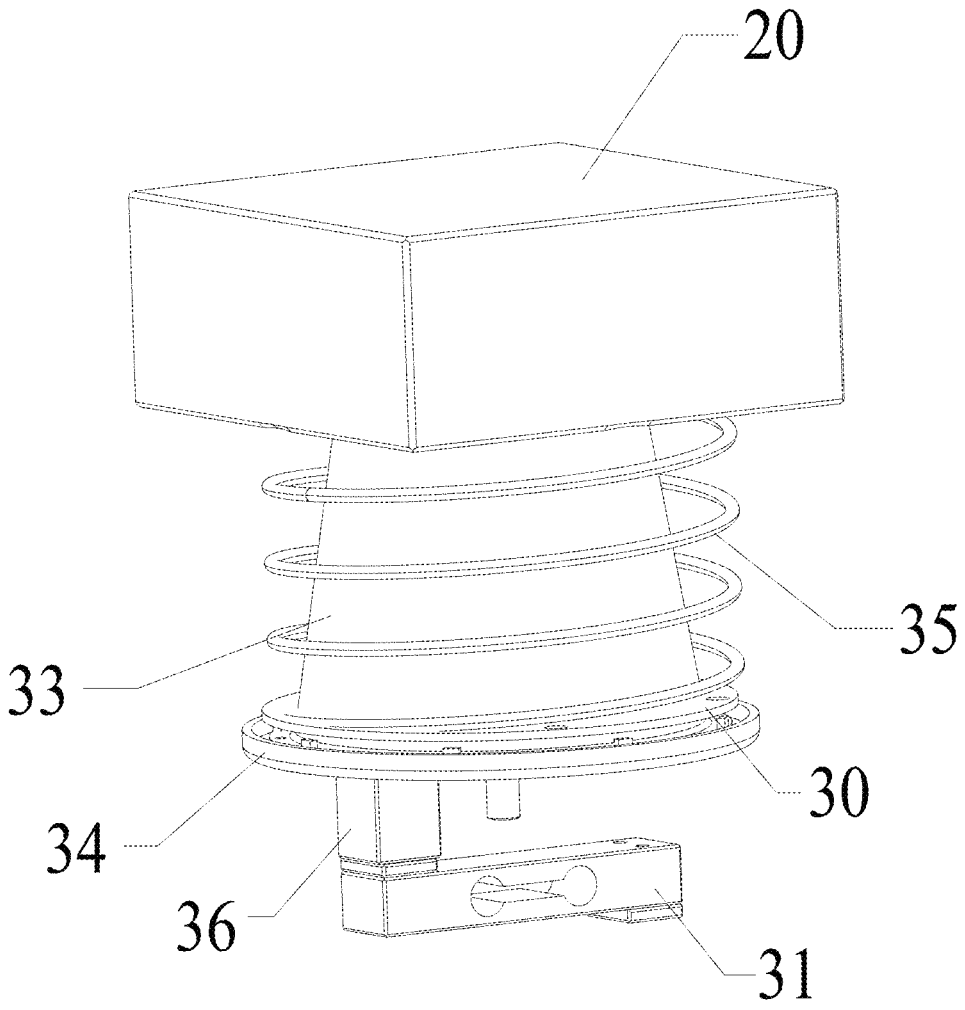
FIG. 3 shows a schematic view of the height adjusting mechanism with the present disclosure.
Figure 4:
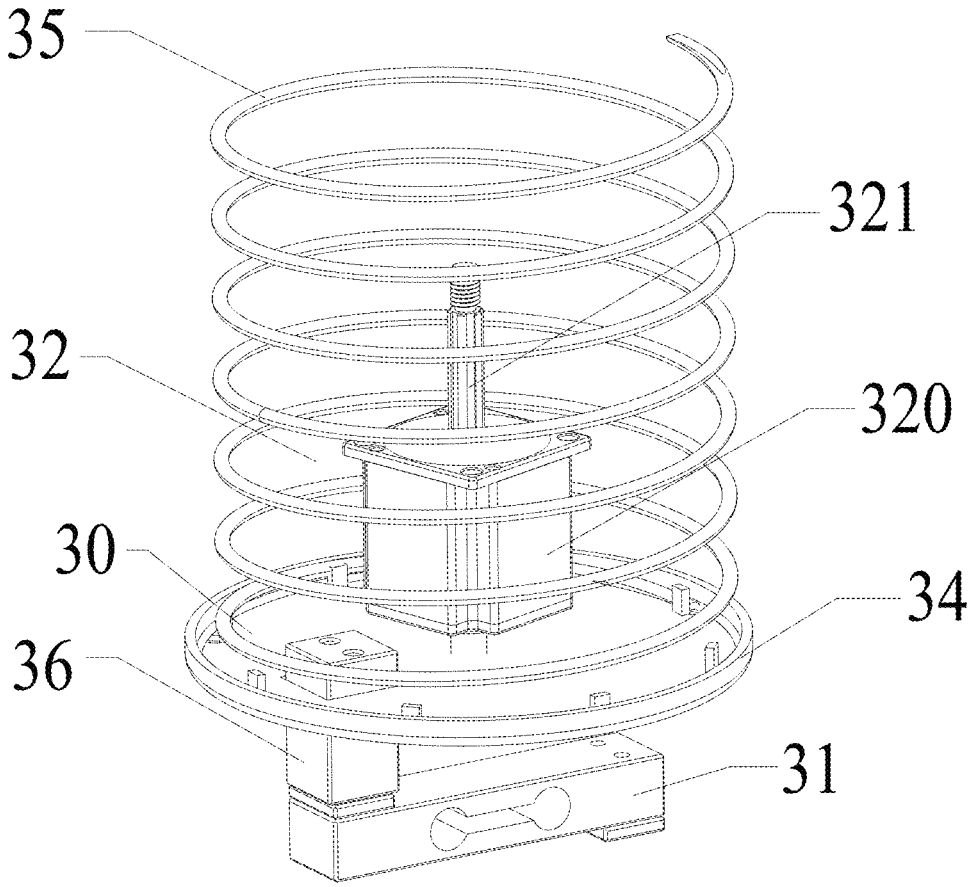
FIG. 4 shows a schematic view of the height adjusting mechanism without the covering.
Figure 5:
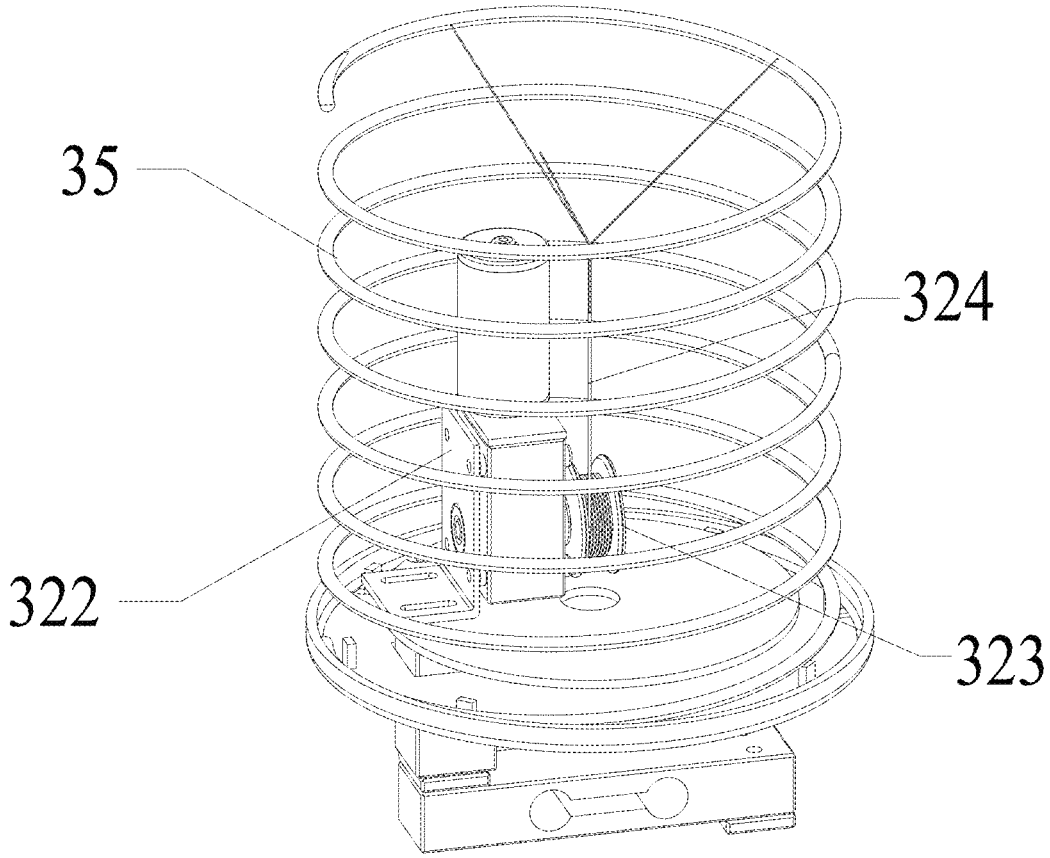
FIG. 5 shows a schematic view of the height adjusting mechanism with an alternative disclosure.
Figure 6:
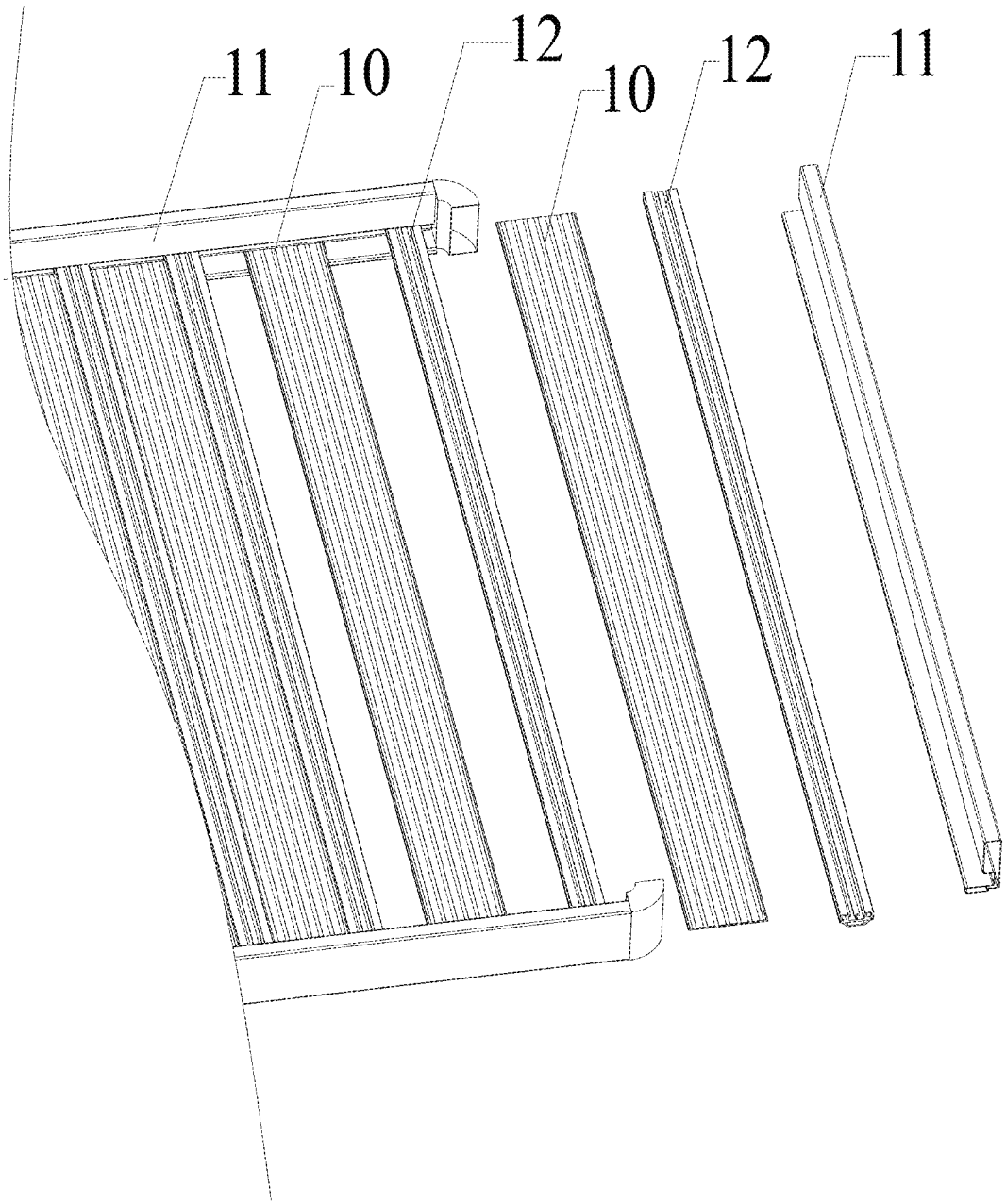
FIG. 6 shows a partially exploded view of the foundation with the present disclosure.

Please refer to FIG. 1 to FIG. 6, the specific structure of a preferred disclosure is shown, which is a smart mattress, including a foundation 1, a sleeping pad and a height adjusting mechanism 3. The height adjusting mechanism 3 includes a positioning plate 30, a pressure sensor 31, an elevating drive device 32, a covering 33, a tray 34 and an elastic member 35. The positioning plate 30 is fixed on the foundation 1, the pressure sensor 31 is located below the positioning plate 30, the tray 34 is located at the bottom of the covering 33, the elastic member 35 is installed on the periphery of the covering 33. One end of the elastic member 35 is fixedly installed on the tray 34, the other end is fixedly connected with a planar deformable member 2, the sleeping pad is defined on the planar deformable member 2, the elevating drive device 32 is used to drive the covering 33 to lift or to drive the elastic member 35 to deform.

The mattress of the present invention automatically monitor the parameters of the human body lying on the sleeping pad via the pressure sensor 31. Based on the parameters monitored by the gravity sensor 31, the pluralities of the independent elevating drive device 32 drive the covering 33 to lift and deform the elastic member 35, in order to adjust the height of specific areas of the sleeping pad and balance the weight of each sleeping position, thereby providing users with the best sleeping comfort. Of course, the elevating drive device 32 can also directly pull the elastic member 35 to extend or retract, so as to adjust the height of the specific area of the planar deformable member 2, then adjust the height of the specific area of the sleeping pad. The specific use is also applicable for back sleeping, side sleeping or turning over during sleeping, the pressure sensor 31 automatically monitors the data and corrects the height of the mattress, thereby achieving an automatic balance adjustment on the mattress as a whole.

More specifically, the embodiment further includes a data control system, a driver, and a terminal system, the driver and the data control system are installed on the foundation 1. The driver, the terminal system, and the pressure sensor 31 are electrically connected to the data control system. The data control system receives parameters from each pressure sensor 31, analyzes and compares the data, and controls the parameters of the elevating drive device 32 via the driver to accurately adjust the height of the sleeping pad. Certainly, the data control system is also able to adjust the positions of specific areas of the sleeping pad to a balanced state based on parameters such as human height, weight, and body shape, combined with real-time detection data from the pressure sensor 31. Meanwhile, the terminal system is an independent remote control, alternatively a mobile phone specific APP, where users is able to adjust the height of the sleeping pad to the most comfortable state based on their own needs, so as to meet their customized needs.

In an embodiment of the mattress according to the invention, the elevating drive device 32 is provided with a hoisting motor 320 and a pushing rod 321 connected to the hoisting motor 320, the pushing rod 321 is fixedly connected to the covering 33 and drives the covering 33 to move up and down, thereby causing the elastic member 35 to extend or retract so as to adjust the height of the planer deformable member 2. In addition, the tray 34 has a sinking distance of 12 mm, which means that there is at least a 12 mm gap between the tray 34 and the positioning plate 30, which has a certain elevating space.

In another embodiment of the mattress according to the invention, the elevating drive device 32 includes a driving motor 322 and a winding assembly, the winding assembly includes a winding reel 323 connected to the driving motor 322 and a wire 324 coiled on the winding reel 323, a free end of the wire 324 is connected to the elastic member 35, as the driving motor 322 drives the winding reel 323 to rotate, the wire 324 is retracted and released, thereby pulling the elastic member 35 to extend or retract, thereby achieving height adjusting.

Preferably, the covering 33 is inverted U-shaped and forms an accommodating cavity, i.e. the covering 33 is substantially in the shape of a hollow cylinder or a circular platform. The tray 34 is provided with an avoidance hole for the elevating drive device 32 to pass through, the elevating drive device 32 is vertically installed on the positioning plate 30 and extends into the accommodating cavity. This design is space-saving during installing, making the unitary structure more compact and aesthetically pleasing.

Preferably, a cushion block 36 is fixedly installed at the bottom of the positioning plate 30, and the pressure sensor 31 is fixedly installed at the bottom of the cushion block 36, the positioning plate 30 is fixedly installed on the foundation 1 via the pressure sensor 31.

In a preferred disclosure, the planar deformable member 2 comprises a plurality of independent cushion blocks 20 arranged in an array, the size of each cushion block 20 is equal or some cushion blocks 20 have the same size, each height adjusting mechanism 3 is independently provided, the elastic member 35 of each height adjusting mechanism 3 is connected with the corresponding cushion block 20 and adjust the height of the corresponding cushion block 20. That is, the combination of the planar deformable member 2 is diverse, which can be formed by an array of multiple equally sized cushion blocks 20, or by combining multiple smaller cushion blocks 20 and larger cushion blocks 20. The quantities of the height adjustment mechanism 3 is also changeable, for example, only some of the cushion blocks 20 is provided with the elastic members 35, while some cushion blocks 20 are not provided with the elastic members 35, it means that elastic member 35 is not essential to cover the entire mattress. For example, when providing a user-customized mattress, it is configured according to personized needs, such as the position of the waist, head, feet, etc., which is adjusted based on its weight to achieve the best comfort even when there are differences in human body shape. Thus the cost of the mattress is significantly reduced.

In a preferred disclosure, the foundation 1 includes a plurality of beams 10 and a plurality of enclosure frames 11, two adjacent beams 10 are fixedly assembled by a metal sheet 12, each enclosure frame 11 is fixed around the assembled beams to form the foundation 1. The mattress is a large item, it is very inconvenient to transport, so the foundation 1 is detachable for easy transportation, and the users could install it on site or at home easily. The beams 10 are fixed together in pairs with the metal sheets 12, and then the enclosure frame 11 is assembled around the assembled beams 10 to form the foundation 1. Finally, the independent height adjustment mechanisms 3 are assembled one by one at the designated positions of the foundation 1, and then connected to the planar deformable member 2.

In order to better improve user comfort, the sleeping pad is configured as a latex sleeping pad, and the elastic member 35 is preferably a spring with good elasticity. A spring cap is provided at the top of the spring to eliminate discomfort caused by contact between the spring and the body.

The above embodiments, which are intended to enable those skilled in the art to understand the content of the disclosure and implement it accordingly, are merely for describing the technical concepts and features of the disclosure, and the scope of patent application of the disclosure cannot be defined only by the embodiments, i.e., any equivalent variations or modifications made in accordance with the spirit disclosed by the disclosure still fall within the scope of claims of the disclosure.

What is claimed is:

1. A smart mattress capable of height adjusting in balanced manner, comprising:

a foundation;

a sleeping pad;

a plurality of height adjusting mechanisms arranged between the foundation and the sleeping pad, the height adjusting mechanism includes a positioning plate, a pressure sensor, an elevating drive device, a covering, a tray and an elastic member; the positioning plate is fixed on the foundation, the pressure sensor is located below the positioning plate, the tray is located at the bottom of the covering, the elastic member is installed on the periphery of the covering; wherein, one end of the elastic member is fixedly installed on the tray, the other end is fixedly connected with a planar deformable member, the sleeping pad is defined on the planar deformable member, the elevating drive device is used to drive the covering to lift or to drive the elastic member to deform; wherein the elevating drive device includes a driving motor and a winding assembly, the winding assembly includes a winding reel connected to the driving motor and a wire coiled on the winding reel, a free end of the wire is connected to the elastic member, as the driving motor drives the winding reel to rotate, the wire is retracted and released, thereby pulling the elastic member to extend or retract; wherein further includes a cushion block, the cushion block is fixedly installed at the bottom of the positioning plate, and the pressure sensor is fixedly installed at the bottom of the cushion block, the positioning plate is fixedly installed on the foundation via the pressure sensor.

2. The smart mattress of claim 1, wherein the elevating drive device is provided with a hoisting motor and a pushing rod connected to the hoisting motor, the pushing rod is fixedly connected to the covering and drives the covering to move up and down.

3. The smart mattress of claim 1, wherein the covering is inverted U-shaped and forms an accommodating cavity, the tray is provided with an avoidance hole for the elevating drive device to pass through, the elevating drive device is vertically installed on the positioning plate and extends into the accommodating cavity.

4. The smart mattress of claim 1, wherein the planar deformable member comprises a plurality of independent cushion pads arranged in an array, the size of each cushion pad is equal or some cushion pads have the same size, each height adjusting mechanism is independently provided, the elastic member of each height adjusting mechanism is connected with the corresponding cushion pad and adjusts the height of the corresponding cushion pad.

5. The smart mattress of claim 1, wherein the foundation includes a plurality of beams and a plurality of enclosure frames, the beams are adjacent and fixedly assembled by a metal sheet, each enclosure frame is fixed around the beams to form the foundation.

6. The smart mattress of claim 1, wherein the sleeping pad is configured as a latex sleeping pad.

7. The smart mattress of claim 1, wherein further includes a data control system, a driver, and a terminal system, the driver and the data control system are installed on the foundation, the driver, the terminal system, and the pressure sensor are electrically connected to the data control system.

* * * * *